US008130236B2

(12) United States Patent
Quan

(10) Patent No.: US 8,130,236 B2
(45) Date of Patent: Mar. 6, 2012

(54) SYSTEMS AND METHODS TO ACHIEVE PREFERRED IMAGER COLOR REPRODUCTION

(75) Inventor: Shuxue Quan, San Diego, CA (US)

(73) Assignee: Aptina Imaging Corporation, George Town (KY)

( * ) Notice: Subject to any disclaimer, the term of this patent is extended or adjusted under 35 U.S.C. 154(b) by 1066 days.

(21) Appl. No.: 12/068,316

(22) Filed: Feb. 5, 2008

(65) Prior Publication Data

US 2009/0195551 A1 Aug. 6, 2009

(51) Int. Cl.
*G09G 5/02* (2006.01)

(52) U.S. Cl. ..... 345/600; 345/589; 345/590; 345/591; 348/254; 348/674; 382/164; 382/165; 382/168; 382/169

(58) Field of Classification Search ..... None
See application file for complete search history.

(56) References Cited

U.S. PATENT DOCUMENTS

| | | | | |
|---|---|---|---|---|
| 5,528,339 | A | 6/1996 | Buhr et al. | |
| 5,611,030 | A | 3/1997 | Stokes | |
| 6,535,301 | B1 * | 3/2003 | Kuwata et al. | 358/1.9 |
| 6,594,388 | B1 | 7/2003 | Gindele et al. | |
| 6,628,823 | B1 | 9/2003 | Holm | |
| 6,727,908 | B1 | 4/2004 | Wright et al. | |
| 6,791,716 | B1 | 9/2004 | Buhr et al. | |
| 7,006,688 | B2 * | 2/2006 | Zaklika et al. | 382/165 |
| 7,023,580 | B2 | 4/2006 | Zhang et al. | |
| 7,054,484 | B2 | 5/2006 | Lyford et al. | |
| 7,262,780 | B2 | 8/2007 | Hu | |
| 2003/0086104 | A1 | 5/2003 | Chen | |
| 2003/0112454 | A1 | 6/2003 | Woolfe et al. | |
| 2004/0012542 | A1 | 1/2004 | Bowsher et al. | |
| 2004/0057614 | A1 | 3/2004 | Ogatsu et al. | |
| 2004/0081369 | A1 | 4/2004 | Gindele et al. | |
| 2005/0275911 | A1 | 12/2005 | Yamada et al. | |
| 2006/0050957 | A1 | 3/2006 | Naccari et al. | |
| 2007/0139677 | A1 | 6/2007 | Kwak et al. | |
| 2007/0160285 | A1 | 7/2007 | Gondek et al. | |
| 2007/0195345 | A1 | 8/2007 | Martinez et al. | |
| 2007/0230777 | A1 | 10/2007 | Tamagawa | |
| 2007/0242162 | A1 | 10/2007 | Gutta et al. | |
| 2007/0242291 | A1 | 10/2007 | Harigai | |
| 2007/0242294 | A1 | 10/2007 | Fujiwara | |

FOREIGN PATENT DOCUMENTS

| | | |
|---|---|---|
| JP | 2001-204041 | 7/2001 |
| JP | 2003-244464 | 8/2003 |
| JP | 2004-153684 | 5/2004 |
| JP | 2005-210657 | 8/2005 |

OTHER PUBLICATIONS

E. Day et al., "A Psychophysical Experiment Evaluating the Color and Spatial Image Quality of Several Multispectral Image Capture Techniques", Journal of Imaging Science and Technology, vol. 48, No. 2, pp. 93-104, Mar./Apr. 2004.

R. Ramanath et al., "Color Image Processing Pipeline", IEEE Signal Processing Magazine, pp. 34-43, Jan. 2005.

(Continued)

*Primary Examiner* — Antonio A Caschera

(57) ABSTRACT

A method and apparatus for processing image pixel signals having at least two color components in which at least some of the image pixel signals are classified into a plurality of classifications and transformed by a transform function associated with the classifications.

20 Claims, 13 Drawing Sheets

OTHER PUBLICATIONS

F. Drago et al., "Design of a Tone Mapping Operator for High Dynamic Range Images Based Upon Psychophysical Evaluation and Preference Mapping", 15th Annual Symposium on Electronic Imaging, 2003.

R. Hunt et al., "The Preferred Reproduction of Blue Sky, Green Grass and Caucasian Skin in Colour Photography", Journal of Photographic Science, vol. 22, pp. 144-149, 1974.

K. Topfer et al., "The Quantitative Aspects of Color Rendering for Memory Colors", IS&T 2000 PICS Conference, 2000.

S. Yendrikhovskij et al., "Color Reproduction and the Naturalness Constraint", Col. Res. Appl. vol. 26, No. 4, pp. 278-289, 2001.

S. Yendrikhovskij et al., "Optimizing Color Reproduction of Natural Images", The 6th Color Imaging Conference, pp. 140-145, 1998.

S. Fernandez et al., "Preferred Color Reproduction of Images with Unknown Colorimetry", 9th Color Imaging Conference, pp. 274-279, 2001.

S. Fernandez et al., Observer Preferences and Cultural Differences in Color Reproduction of Scenic Images, 10th Color Imaging Conference, pp. 66-72, 2002.

J. Kuang et al., "A Psychophysical Study on the Influence Factors of Color Preference in Photographic Color Reproduction", in Proc. SPIE Electronic Imaging, vol. 5668, San Jose, CA, 2005.

H. de Ridder, "Naturalness and Image Quality: Saturation and Lightness Variation in Color Images of Natural Scenes", Journal of Imaging Sciences and Technology, vol. 40, No. 6, pp. 487-493, 1996.

R. Hunt, "How to Make Pictures and Please People", IS&T/SID Color Imaging Conference, Scottsdale, AZ, 1999.

D. Sanger et al., "Facial Pattern Detection and its Preferred color Reproduction", IS&T/SID Color Imaging Conference, Scottsdale, AZ, 1994.

C. Boust et al., "Does an Expert Use Memory Colors to Adjust Images?", IS&T/SID Color Imaging Conference, Scottsdale, AZ, 2004.

* cited by examiner

SYSTEMS AND METHODS TO ACHIEVE PREFERRED IMAGER COLOR REPRODUCTION

TECHNICAL FIELD

Embodiments described herein relate generally to imaging and more particularly to techniques for achieving preferred color reproduction.

BACKGROUND

Imagers reproduce an image by converting photons to a signal that is representative of the image. A key feature of an imager is its ability to accurately reproduce the colors of an image. However, even if the reproduced colors are highly accurate, those colors may differ from the colors preferred by a person viewing the reproduced image. For example, the color response of the human eye may differ from the color response of the imager. In another example, the physiological effects correlated with the image attributes may affect the perceived quality of the image.

Colors in a pictorial image are typically assessed by comparing the reproduced colors with a human memory of the respective usual colors of similar objects. However, both the reproduced colors and the input from original colors to the human memory are subject to a variety of physical, physiological, and psychological effects. Accordingly, the reproduced colors in the pictorial image and the preferred colors may not be the same.

Thus, systems and methods to achieve preferred color reproduction are needed.

BRIEF DESCRIPTION OF THE DRAWINGS

In the drawings, like reference numbers indicate identical or functionally similar elements. Additionally, the leftmost digit(s) of a reference number identifies the drawing in which the reference number first appears.

DETAILED DESCRIPTION

Figure 1:
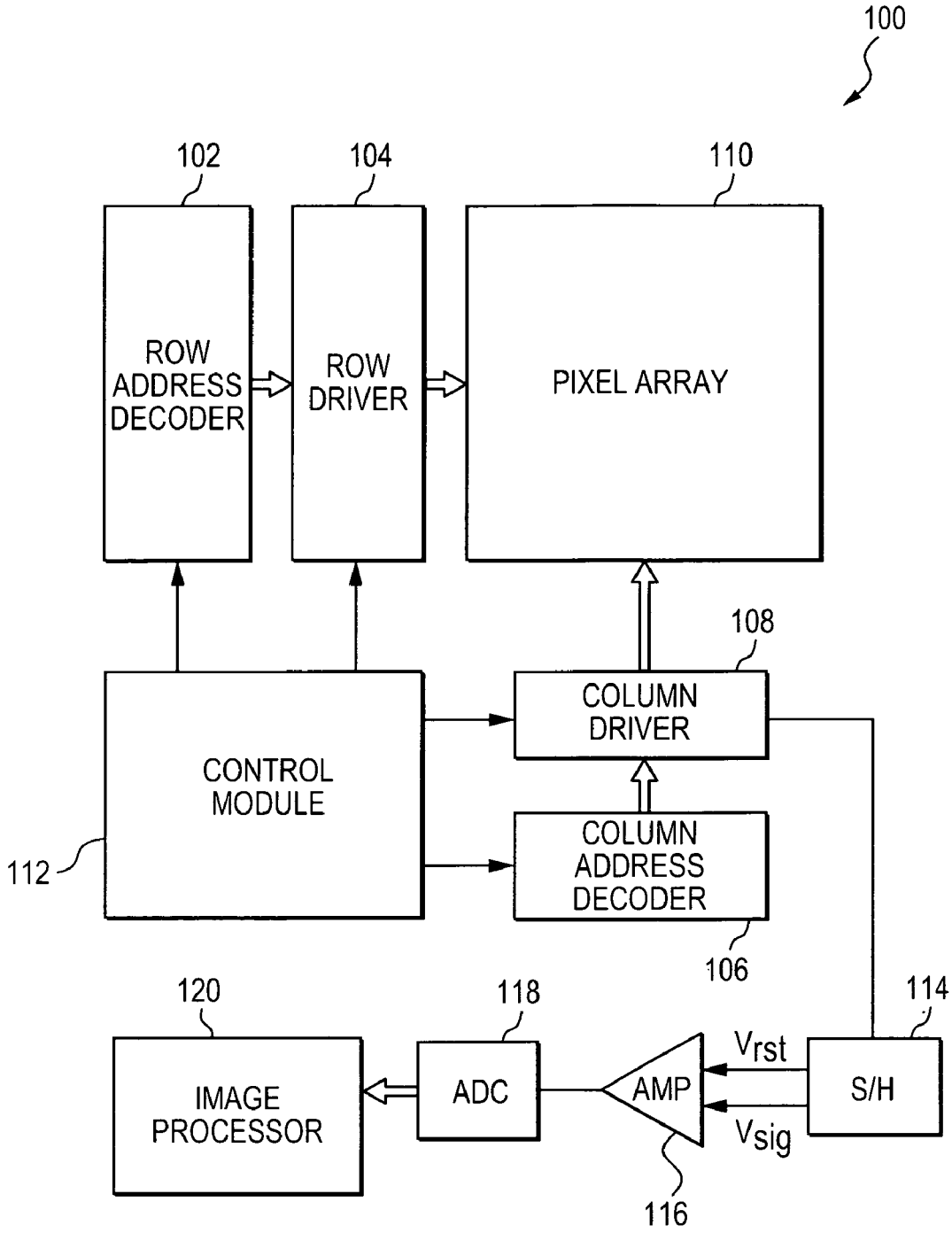
FIG. 1 is an example implementation of an imager.

Although the embodiments described herein refer specifically, and by way of example, to imagers and components thereof, including photosensors and image processors, it will be readily apparent to persons skilled in the relevant art(s) that the embodiments are equally applicable to other devices and systems. It will also be readily apparent to persons skilled in the relevant art(s) that the embodiments are applicable to any apparatus or system requiring preferred color reproduction.

Embodiments described herein manipulate color components of one or more image pixels in a pixel array to cause the reproduced colors in a pictorial image to more closely match the colors preferred by a person viewing the reproduced image. The preferred color of a color component may depend upon the pictorial characteristic represented by the corresponding image pixel. Examples of pictorial characteristics include but are not limited to green foliage, flowers, blue sky, and skin tones. The image pixels are assigned among a plurality of classifications with each classification representing a different pictorial characteristic. The color components of the respective image pixels assigned to each classification are transformed using transforms associated with the respective classifications. For instance, color components of image pixels assigned to a first classification may be transformed using a first transform. Color components of image pixels assigned to a second classification may be transformed using a second transform, and so on.

Different transforms may be used for different classifications, though the scope of the embodiments is not limited in this respect. For example, the difference between color components indicative of green foliage and the respective preferred color components for the green foliage may not be the same as the difference between color components indicative of skin and the respective preferred color components for the skin.

Techniques for achieving preferred color reproduction may be performed using color components in the RGB color space, though converting the RGB color components to components of another color space (e.g., YCbCr) may reduce the processing required. For example, the preferred imager color reproduction techniques may be performed entirely or partially in the YCbCr color space. In this example, red, green, and blue components of an image may be converted to YCbCr components using the matrix equation:

$$\begin{bmatrix} Y \\ Cb \\ Cr \end{bmatrix} = \begin{bmatrix} 0.299 & 0.587 & 0.114 \\ 0 & -1 & 1 \\ 1 & -1 & 0 \end{bmatrix} \begin{bmatrix} R \\ G \\ B \end{bmatrix} \quad \text{(Equation 1)}$$

The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the art to effect such feature, structure, or characteristic in connection with other embodiments whether or not explicitly described.

FIG. 1 is an example implementation of an imager. In FIG. 1, imager 100 is a CMOS imager, which includes a pixel array 110 having a plurality of pixels arranged in a predetermined number of columns and rows. The pixels in a given row of pixel array 110 are turned on at the same time by a row select line, and the pixel signals of each column are selectively provided to output lines by column select lines. A plurality of row and column select lines is provided for the entire pixel array 110.

Row driver 104 selectively activates the row lines in response to row address decoder 102. Column driver 108 selectively activates the column select lines in response to column address decoder 106. Thus, a row and column address is provided for each pixel in pixel array 110.

Control module 112 controls row address decoder 102 and column address decoder 106 for selecting the appropriate row and column select lines for pixel readout. Control module 112 further controls row driver 104 and column driver 108, which apply driving voltages to the respective drive transistors of the selected row and column select lines. A sample-and-hold (S/H) circuit 114 associated with column driver 108 reads a pixel reset signal $V_{rst}$ and a pixel image signal $V_{sig}$ for selected pixels. Differential amplifier (amp) 116 provides a differential signal (e.g., $V_{rst}-V_{sig}$) for each pixel. Analog-to-digital converter (ADC) 118 digitizes each of the differential signals, which are provided to image processor 120. Although one S/H circuit 114, differential amplifier 116, and ADC 118 are shown in FIG. 1, which may be selectively coupled to the column lines of pixel array 110, this is merely one representative structure. A S/H circuit 114, differential amplifier 116, and ADC 118 may be provided for each column line of pixel array 110. Other arrangements can also be provided using S/H circuits 114, differential amplifiers 116, and ADCs 118 for sampling and providing digital output signals for the pixels of array 110.

Image processor 120 manipulates the digital pixel signals to provide an output image color reproduction of an image represented by the plurality of pixels in pixel array 110. Image processor 120 may perform any of a variety of operations, including but not limited to positional gain adjustment, defect correction, noise reduction, optical crosstalk reduction, demosaicing, resizing, sharpening, etc. Image processor 120 may perform any of the preferred color reproduction techniques described herein after demosaicing is performed. For instance, each pixel initially has a single color component. Image processor 120 performs a spatial interpolation operation (i.e., demosaicing) to provide each pixel with a plurality of color components. Any two or more of these color components may be used by image processor 120 to perform the preferred color reproduction techniques described herein. Image processor 120 may be on the same chip as imager 100, on a different chip than imager 100, or on a different standalone processor that receives a signal from imager 100.

Figure 2:
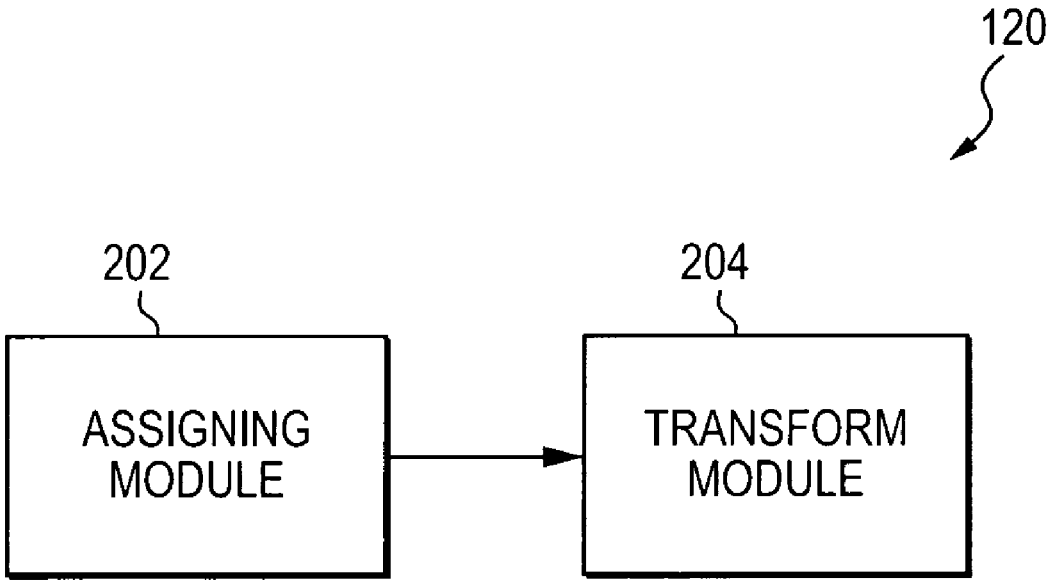
FIG. 2 is an example implementation of a portion of an image processor in accordance with an embodiment disclosed herein.

FIG. 2 is an example implementation of a portion of an image processor, such as image processor 120 of FIG. 1, in accordance with an embodiment disclosed herein. In FIG. 2, image processor 120 includes an assigning module 202 and a transform module 204. Assigning module 202 receives a signal, such as a digitized signal, for each pixel of an image. Each signal includes at least a first color component and a second color component. Although the output signal from a pixel array may be in an RGB color space in which, after demosaicing, each pixel has RGB color components, these signals may then be converted into a color space having two color components. For example, a color component may be a Cb or Cr component of a YCbCr or Y'CbCr color space, an a* or b* component of a CIELAB color space, a U or V component of a YUV color space, an I or Q component of a YIQ color space, a Db or Dr component of a YDbDr color space, a Pb or Pr component of a YPbPr color space, or a color component of any other suitable color space. Continued reference is made throughout this disclosure to the Cb and Cr components of the YCbCr color space for ease of discussion. However, such reference is not intended to limit the scope of the embodiments described herein. To the contrary, persons skilled in the relevant art(s) will recognize that the disclosure herein, including the described embodiments, is applicable to any suitable color space having color components.

Assigning module 202 assigns pixels among classifications that are defined by respective predetermined relationships between the first and second color components of a pixel. For example, a first classification may be defined by a first relationship between the first and second color components, and a second classification may be defined by a second relationship between the first and second color components. If a signal for a pixel includes first and second color components that satisfy the first relationship, then assigning module 202 assigns the pixel to the first classification. If the signal includes first and second color components that satisfy the second relationship, then assigning module 202 assigns the pixel to the second classification. Although two classifications are described in this example for illustrative purposes, it will be recognized by persons skilled in the relevant art(s) that image processor 120 may utilize any number of classifications. Such classifications may be mutually exclusive, if desired. The classifications are described in greater detail below.

Transform module 204 performs a non-linear transform of the first and second color components of each pixel that is assigned to a classification. Each classification corresponds to a different non-linear transform. For instance, transform module 204 performs a first non-linear transform of the first and second color components in the respective signal of each pixel that is assigned to the first classification. Transform module 204 performs a second non-linear transform of the first and second color components in the respective signal of each pixel that is assigned to the second classification, and so on. The first non-linear transform may differ from the second non-linear transform. The third non-linear transform may differ from the respective first and second non-linear transforms, and so on. However, the non-linear transforms corresponding with different classifications need not necessarily differ.

The classifications may be selected to represent any of a variety of pictorial characteristics, including but not limited to green foliage, flowers, blue sky, or skin tones. For example, the difference between color components of a pixel that represent green foliage and the respective preferred color components for green foliage may not be the same as the difference between color components that represent blue sky and the respective preferred components for blue sky. Accordingly, the non-linear transform used to transform the color components that represent green foliage to the preferred color components for green foliage may differ from the non-linear transform used to transform the color components that represent blue sky to the preferred color components for blue sky. The classifications may be mutually exclusive, though the scope of the embodiments described herein are not limited in this respect. For instance, the relationships between the first and second color components that define the respective flower and skin tone classifications may overlap.

Not all pixels of pixel array 110 are necessarily assigned to a classification. Accordingly, the respective signals of some pixels may include color components that are not transformed as described above. In a first example, if the first and second color components in a signal of a pixel do not satisfy any of the predetermined relationships that define the respective classifications, then the pixel is not assigned to a classification. In this example, the first and second color components of the pixel are not transformed in accordance with the non-linear transform techniques described herein. In an alternative example, if the first and second color components in the signal of the pixel do not satisfy any of the predetermined relationships, then the pixel may be assigned to a classification designated for pixels that do not fall within the other classifications. Such a classification may be referred to as an overflow classification. Color components of pixels in an overflow classification may be transformed in accordance with the non-linear techniques described herein.

Non-linear transformation of color components will be discussed below with reference to the luminance-chrominance (YCbCr) color space, though the scope of the embodiments described herein are not limited in this respect. The embodiments are applicable to any color space having color components. The following discussion will focus on classifications of foliage green, sky blue, and skin tone for illustrative purposes. However, these classifications are not intended to limit the scope of the embodiments described herein, and persons skilled in the relevant art(s) will recognize that the embodiments may use any suitable one or more classifications.

Figure 13:
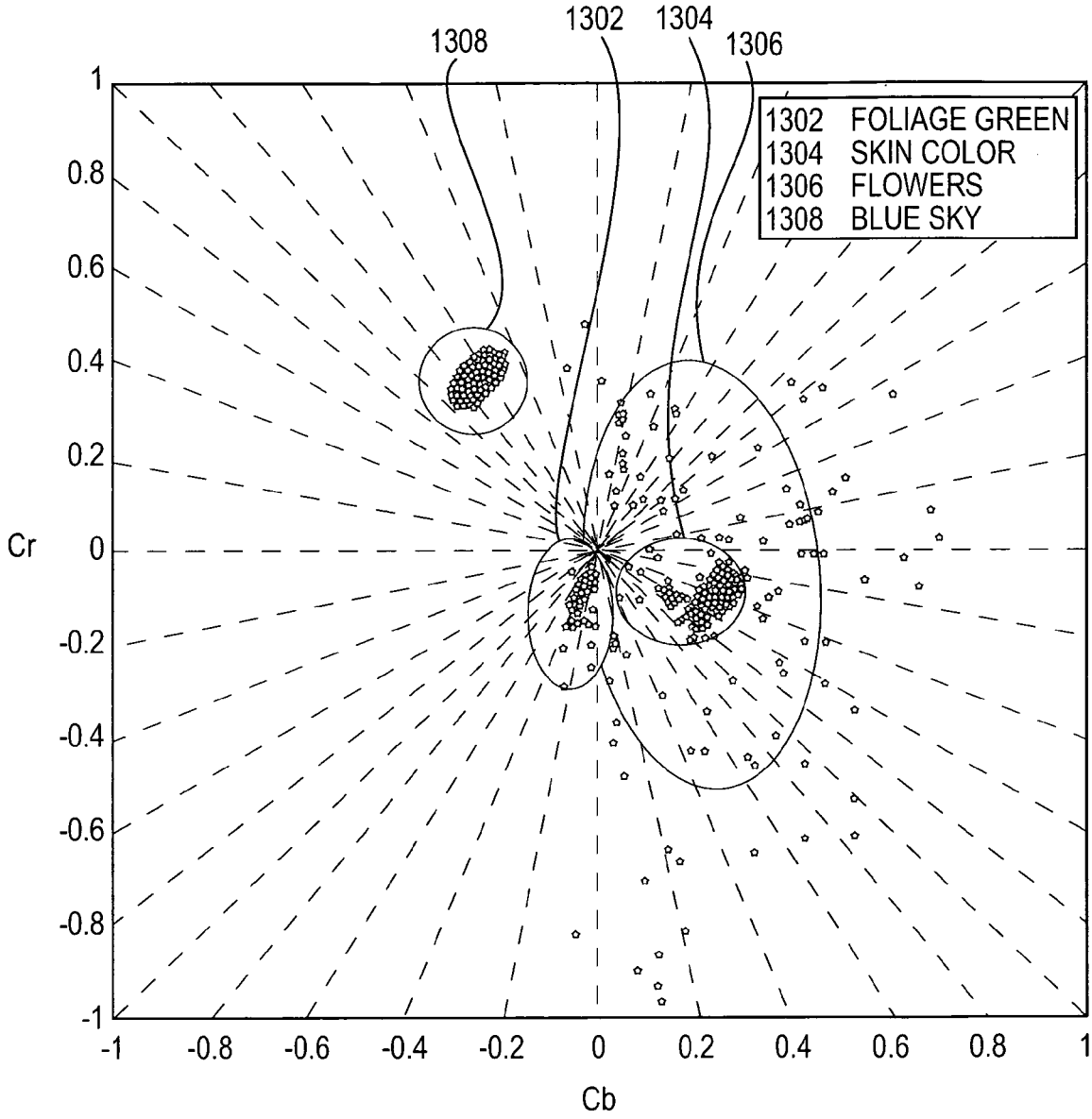
FIG. 13 is a plot of image pixels in the CbCr plane of a YCbCr color space according to an embodiment disclosed herein.

FIG. 13 is a plot of image pixels in the CbCr plane of a YCbCr color space according to an embodiment disclosed herein. Cr color component values are represented along the X-axis of the CbCr plane, and Cb color component values are represented along the Y-axis. Clusters of pixels representing foliage green 1302, skin tone color 1304, and sky blue 1308 are concentrated in relatively small ranges in the CbCr plane; whereas, the cluster of pixels representing flowers 1306 covers a relatively larger area of the CbCr plane. Depending on the lighting levels, these clusters 1302, 1304, 1306, 1308 can be closer to or farther from the origin of the CbCr plane, moving along the radial direction. Classifications corresponding with respective clusters 1302, 1304, 1306, 1308 may be defined by equations corresponding with the respective boundaries of the clusters 1302, 1304, 1306, 1308, though the equations need not track the entire respective boundaries or correspond exactly with the respective boundaries. For example, each classification may be defined by two line equations, one on either side of the respective corresponding cluster 1302, 1304, 1306, 1308 in the CbCr plane.

By assuming hue is constant in the CbCr plane, these line equations, $L_1$ and $L_2$, may be written as:

$$L_1: C_b > k_1 \cdot C_r \quad \text{(Equation 2)}$$

$$L_2: C_b < k_2 \cdot C_r \quad \text{(Equation 3)}$$

FIG. 13 shows a plurality of lines passing through the origin of the CbCr plane. The lines, $L_1$ and $L_2$, may be any of the lines shown in FIG. 13 or any other lines that pass through the origin of the CbCr plane. In this example, the coefficients, $k_1$ and $k_2$, are selected such that the region between the lines includes at least 95% of the samples of the corresponding cluster. Referring to FIG. 13, the classifications of foliage green 1302, sky blue 1308, and skin tone color 1304 may be defined by the equations:

$$\text{Foliage: } C_b < C_r \text{ and } C_b > 10 * C_r \quad \text{(Equation 4)}$$

$$\text{Sky: } C_b < -\frac{1}{0.4} * C_r \text{ and } C_b > -0.6 * C_r \quad \text{(Equation 5)}$$

$$\text{Skin: } C_b < -0.1 * C_r \text{ and } C_b > -\frac{1}{0.8} * C_r \text{ and } R < 1.75 * G \quad \text{(Equation 6)}$$

wherein $C_b$ and $C_r$ represent respective blue and red chroma components in the YCbCr color space, and R and G represent respective red and green color components in an RGB color space based on $C_b$ and $C_r$. It should be noted that a third line equation is included to facilitate defining the skin tone color classification 1304 to differentiate skin color from orange color.

Although pixel signals are typically processed in one color space, Equation 6 shows that pixel signals having color components in one color space may be processed to obtain corresponding color components in another color space. For example, blue and red chroma components of a pixel in the YCbCr color space may be processed to obtain red and green color components of the pixel in the RGB color space to facilitate defining the skin tone color classification 1304, as shown in Equation 6 above, using the matrix equation:

$$\begin{bmatrix} R \\ G \\ B \end{bmatrix} = \begin{bmatrix} 1 & -0.114 & 0.701 \\ 1 & -0.114 & -0.299 \\ 1 & 0.886 & -0.299 \end{bmatrix} \begin{bmatrix} Y \\ Cb \\ Cr \end{bmatrix} \quad \text{(Equation 7)}$$

Transform module 204 may perform any of a variety of non-linear transforms. In one example implementation, each non-linear transform is represented generally by the following equations:

$$\begin{cases} y = a^{1-\gamma} * x^{\gamma} & \text{for } 0 \le x \le a \text{ and} \quad \text{(Equation 8)} \\ y = 1 - (1-a)^{1-\gamma}(1-x)^{\gamma} & \text{for } a < x \le 1 \quad \text{(Equation 9)} \end{cases}$$

wherein y represents the transformed $C_b$ when x represents the initial $C_b$, y represents the transformed $C_r$ when x represents the initial $C_r$, y represents the transformed combined color component $C=\sqrt{C_b^2+C_r^2}$ when x represents the initial combined color component $C=\sqrt{C_b^2+C_r^2}$, a represents a transition point of the non-linear transform, and γ represents a linearity factor of the non-linear transform. These equations may be used to adjust image contrast and/or saturation, to provide some examples.

Figure 3:
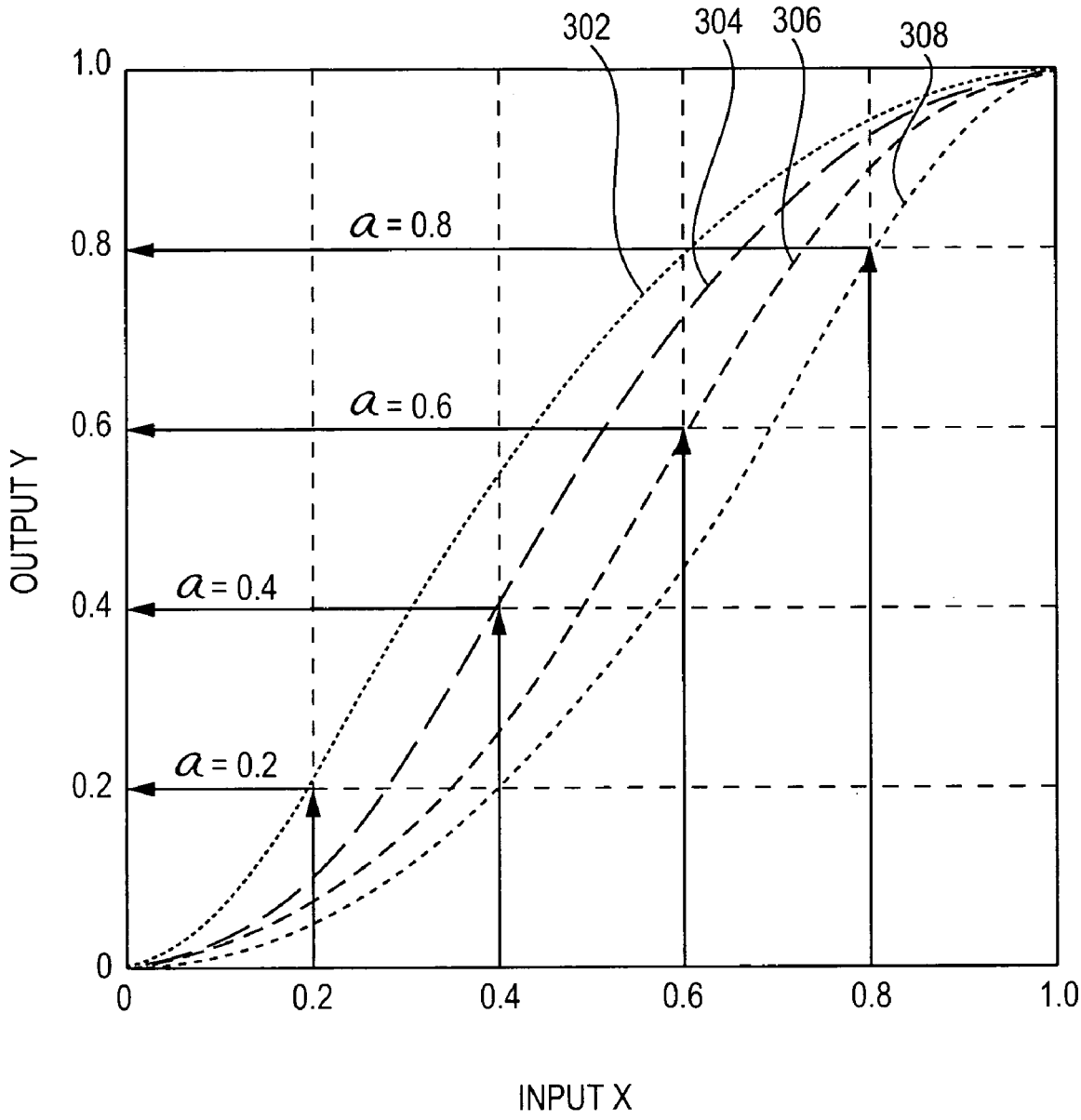
FIGS. 3-5 show example curves associated with respective non-linear transforms in accordance with embodiments disclosed herein.
Figure 4:
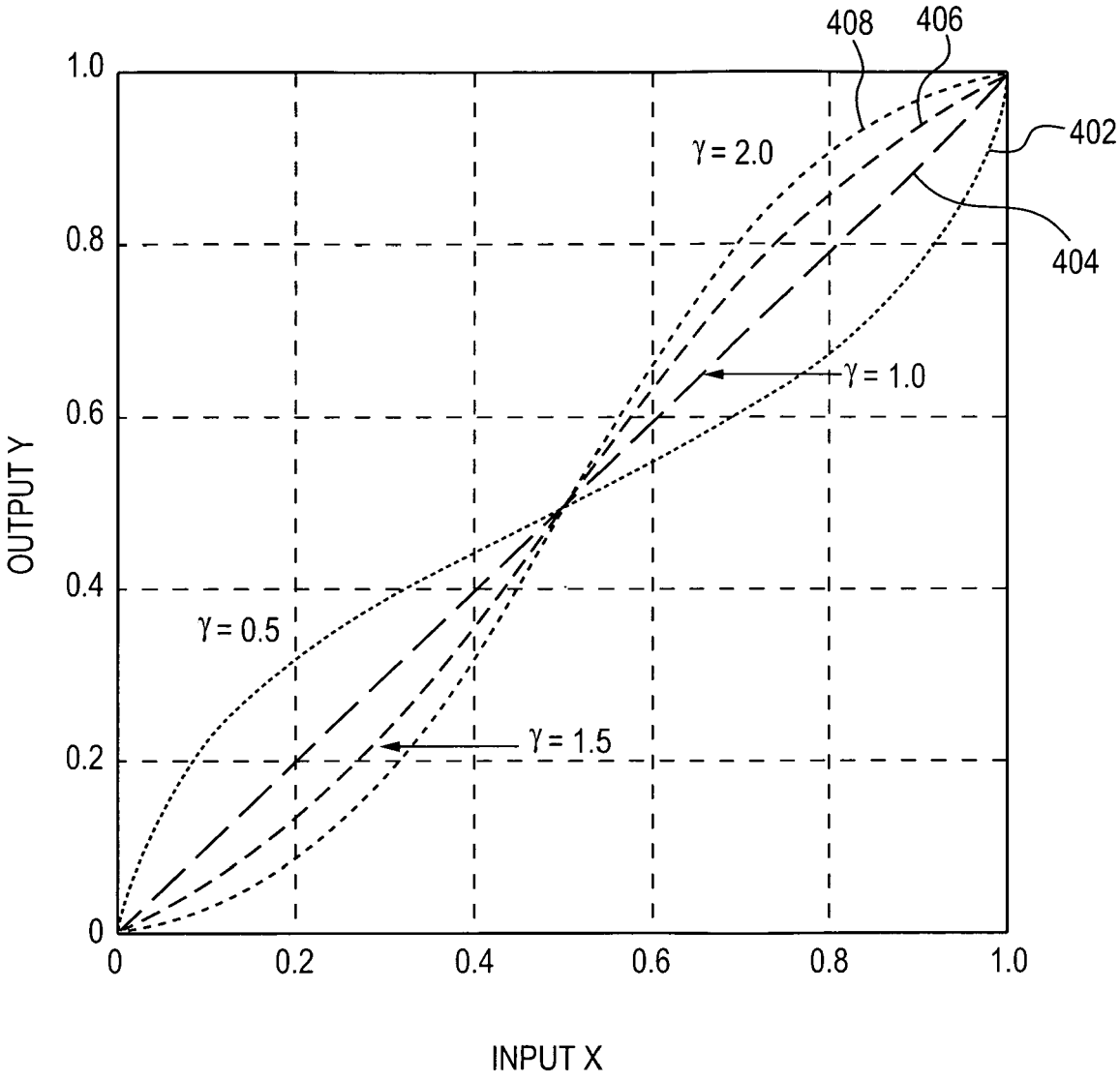

FIGS. 3 and 4 show example curves 302-308 and 402-408, respectively, based on Equations 8-9 provided above in accordance with embodiments disclosed herein. Each of curves 302-308 and 402-408 represents a transform, which may be applied to a color component of a pixel. In FIGS. 3 and 4, color component values are represented along the X-axis, and the corresponding transformed color component values are represented along the Y-axis.

As illustrated in FIGS. 3 and 4, the transition point a and/or linearity factor γ of Equations 8-9 may be changed to adjust image contrast and/or saturation of an image. FIG. 3 shows how different transition point a values affect the shape of a curve corresponding to a non-linear transform. In FIG. 3, curves 302, 304, 306, and 308 have a linearity factor γ of 2 and respective transition points a of 0.2, 0.4, 0.6, and 0.8 for illustrative purposes. FIG. 4 shows how different linearity factor γ values affect the shape of a curve corresponding to a non-linear transform. In FIG. 4, curves 402, 404, 406, and 408 have a transition point a of 0.5 and respective linearity factors γ of 0.5, 1.0, 1.5, and 2.0 for illustrative purposes. The transition point a values and linearity factor γ values shown in FIGS. 3 and 4 are provided by way of example and are not intended to be limiting. Persons skilled in the relevant art(s)

will recognize that the transition point a and the linearity factor γ of Equations 8-9 may be any respective values.

Figure 5:
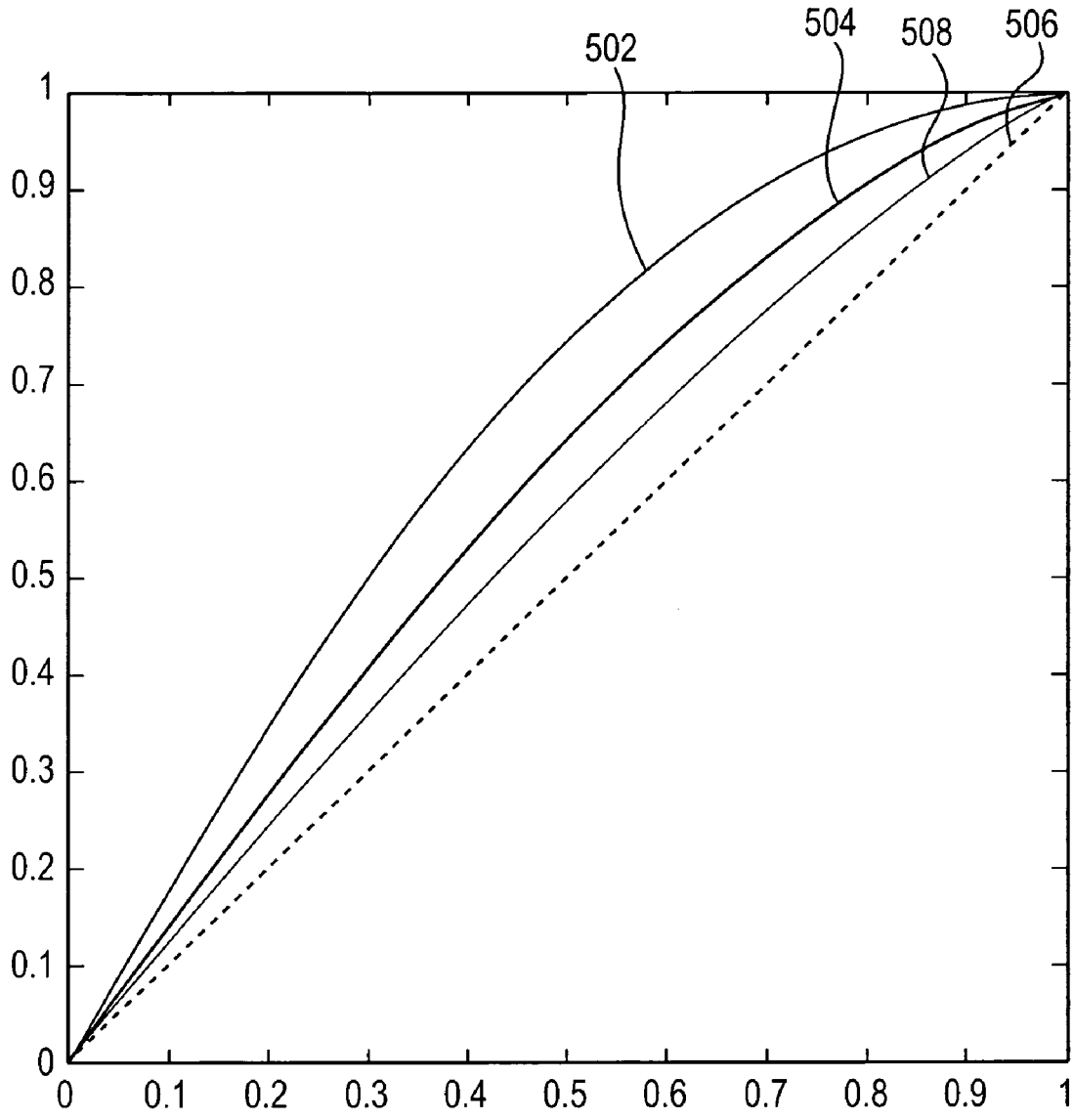

FIG. 5 shows curves 502, 504, and 506 representing the non-linear transforms of respective foliage green, sky blue, and skin color components in accordance with an embodiment disclosed herein. In FIG. 5, curves 502, 504, and 506 have a transition point a of 0.02 and respective linearity factors γ of 2.0, 1.5, and 1.0 for illustrative purposes. Curve 508 represents the non-linear transform of all color components that do not satisfy any of the relationships defining the foliage green, sky blue, or skin color classifications. Curve 508 has a transition point a of 0.02 and a linearity factor γ of 1.25 for illustrative purposes.

Figure 6:
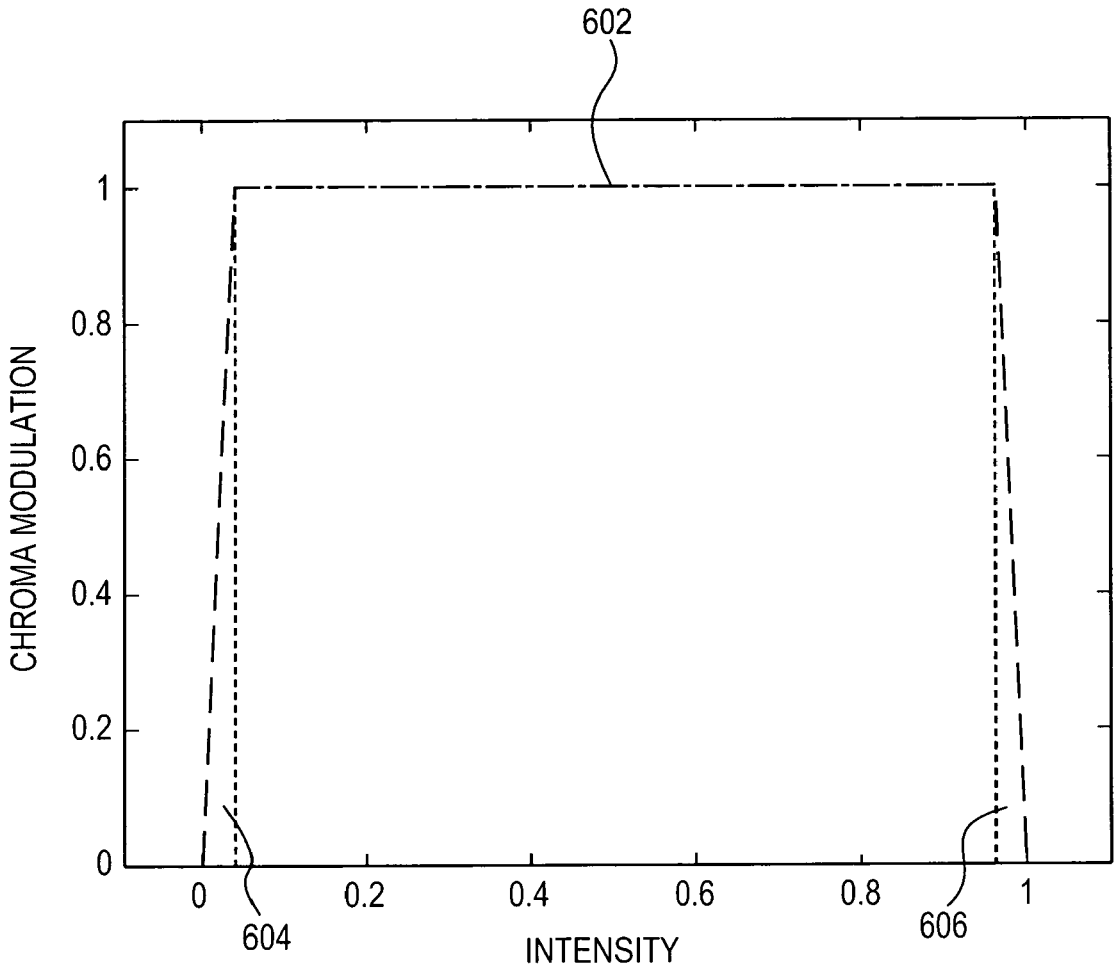
FIG. 6 shows an example chroma modulation curve as a function of luminance intensity in accordance with an embodiment disclosed herein.

After performing a non-transform of color components of a pixel, the transformed color components may be processed to facilitate preferred color reproduction of the image. For instance, the transformed color components may be processed to suppress chroma noise, as illustrated in FIG. 6. FIG. 6 shows an example chroma modulation curve 602 as a function of luminance intensity in accordance with an embodiment disclosed herein. Chroma modulation curve 602 is applied onto the intensity channel and is multiplied with the transformed color components to suppress chroma noise in dark region 604 and bright region 606. Chroma modulation curve 602 is shown to be a trapezoidal curve for illustrative purposes and is not intended to be limiting. Persons skilled in the relevant art(s) will recognize that chroma modulation curve 602 may have any suitable shape. In FIG. 6, the transition points a of chroma modulation curve 602 are selected at 0.04 and 0.96 (e.g., approximately 10 and 245 in the range of [0,255]) for illustrative purpose, though a may be any value.

The transformed color components of a pixel may be converted into the RGB color space for some post-transform processing techniques. For example, the contrast and/or saturation of an image may be enhanced using any of a variety of techniques in the RGB color space, including but not limited to a histogram equation, an S-shape tone scale process curve, etc. An S-shape tone scale curve (i.e., an S-curve) may be implemented in a number of ways. For example, the S-curve may not be dependent on a histogram of the image. In another example, images representing different objects are assigned different S-curves. For instance, a first S-curve may be assigned to an image representing scenery, a second S-curve may be assigned to an image representing people, etc. In yet another example, an S-curve (e.g., a sine curve or a Gaussian function) may be controlled with an amplitude factor for adjusting the contrast of the image.

A tone mapping technique may be utilized to facilitate enhancement of image contrast. For example, a histogram may be calculated for a luma component of the image, black and white levels may be calculated based on the histogram, and the tone mapping curve may be calculated and applied to the red, green, and blue components of the image.

The histograms of the RGB components are assigned to a predefined number N of bins (e.g., N=16). The expected proportion of pixels in each bin is 1/N (e.g., 1/16), assuming the lightness of pixels in an image is uniformly distributed. In reality, the distribution may not be uniform. For instance, limitations of a device may cause relatively less distribution at the dark end and/or at the bright end of the bins. The black level of the dark end may be removed and/or the white point in the bright end may be expanded to extend the dynamic range, which may increase contrast of the image. For example, if the proportion of pixels in the first one or two bins at the dark end is relatively low (e.g., less than 10% of the uniform distribution), such bins may be designated as black level ($x_0$). If the proportion of pixels in the first one or two bins at the bright end is relatively low (e.g., less than 10% of the uniform distribution), such bins may be designated as white level ($x_1$).

The maximum envelope of the three histograms may be calculated to avoid clipping of one or two components. Assuming nY is the histogram of the maximum envelope for N=16 in this example, the black level and the white level may be determined using the pseudo code:

```
If nY(1) < (1/16*0.10),
    x0=1/16/2+(1−160*nY(1))*1/16/2;
else
    x0=0;
else if (nY(1) < (1/16*0.10)) & (nY(2) < (1/16*0.10)),
    x0=1/16/2*3+(1−160*nY(2))*1/16/2;
end;
if nY(16) < (1/16*0.10),
    x1=1−1/16/2−(1−160*nY(16))*1/16/2;
else
    x1=1;
else if (nY(16) < (1/16*0.10)) & (nY(15) < (1/16*0.10)),
    x1=1−1/16/2*3−(1−160*nY(15))*1/16/2;
end;
```

Persons skilled in the relevant art(s) will recognize that other algorithms may be used to calculate the black level and the white level.

Once the black level and the white level are calculated, the range [$x_0$, $x_1$] may be expanded using the equations:

$$a = \frac{x_0 + x_1}{2} \quad \text{(Equation 10)}$$

$$x' = \min[\max[x - x_0, 0] * 1/(x_1 - x_0), 1] \quad \text{(Equation 11)}$$

A power number (e.g., γ=1.2) may be applied to achieve a mild sigmoid effect, though the embodiments described herein are not limited in this respect.

After the tone mapping curve is obtained, it is applied to one or more of the RGB components. For example, the tone mapping curve may be applied to each component individually. In another example, the tone mapping curve is applied to only to the luma component(s).

Figure 7:
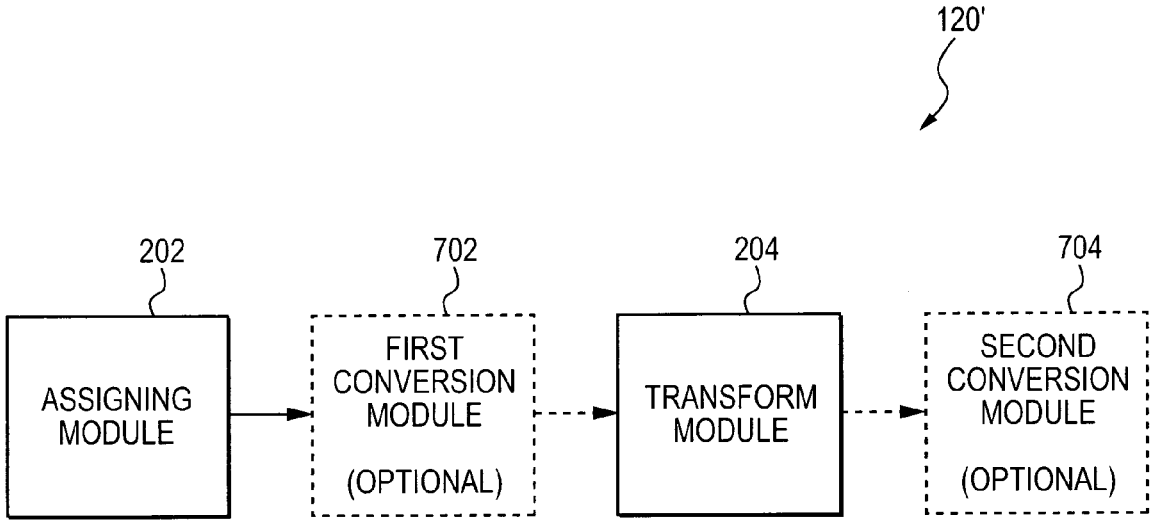
FIGS. 7-8 show example implementations of image processors in accordance with embodiments disclosed herein.
Figure 8:
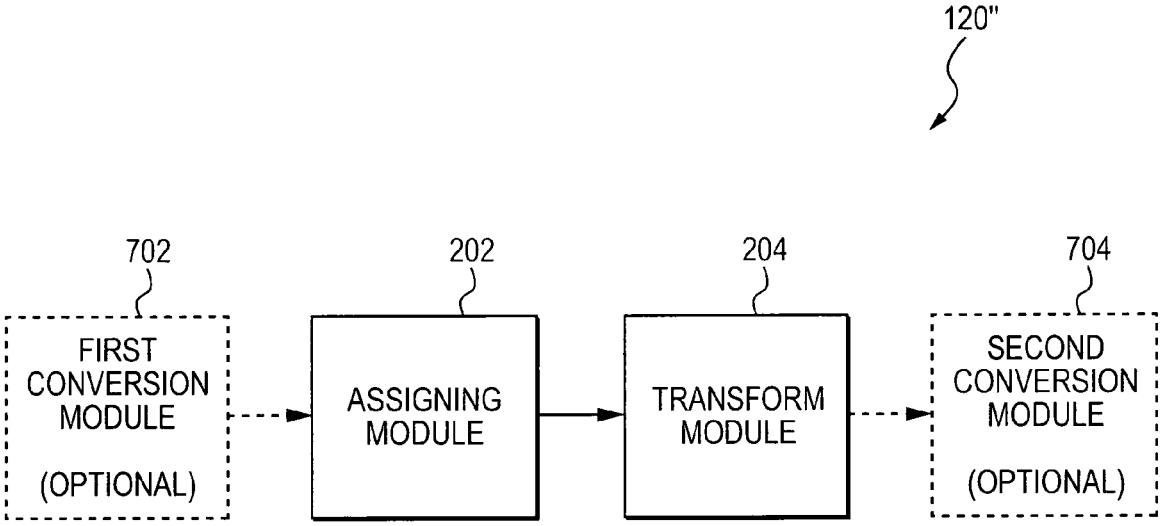

Any of the embodiments described herein may use color space conversion(s) to convert from a first set of components to another set of components. Assigning module 202 and/or transform module 204 may perform such conversion(s), though other modules may be used to perform color space conversion. For example, FIGS. 7-8 show example implementations of image processors, such as image processor 120 of FIG. 1, in accordance with embodiments disclosed herein. In FIGS. 7 and 8, image processors 120', 120" include optional first and second conversion modules 702, 704, which are configured to convert components in a signal of a pixel from a first color space to a second color space. For example, first conversion module 702 may convert red, green, and blue components of an RGB color space to luminance (or luma), blue chroma, and red chroma components of a YCbCr color space. In this example, second conversion module 704 may convert the luminance (or luma), blue chroma, and red chroma components back to red, green, and blue components. It will be recognized by persons skilled in the relevant art(s) that first conversion module 702 and second conversion module 704 may be configured to convert between any respective color spaces.

In FIG. 7, first conversion module 702 is optionally coupled between assigning module 202 and transform module 204. Accordingly, assigning module 202 assigns a pixel to a classification defined by relationships between color components of a first color space. First conversion module 702 may convert the color components of the first color space to color components of a second color space. Transform module 204 may perform a non-linear transform of the color components of the second color space to provide transformed color components based on the classification of the pixel. The combination of the conversion of the color components from the first color space to the second color space and the non-linear transform of the color components of the second color space is defined herein to be a transform of the color components of the first color space to provide transformed color components of the first color space.

Color space conversion(s) may be performed by assigning module 202 and/or transform module 204 in lieu of, or in combination with, first and/or second conversion modules 702, 704. For instance, the conversion of the color components from the first color space to the second color space and the non-linear transform of the color components of the second color space may be performed by transform module 204.

In FIG. 8, first conversion module 702 may convert components in a signal of a pixel from the first color space to the second color space. Assigning module 202 may assign the pixel to a classification that is defined by relationships between the components corresponding with the second color space. Transform module 204 may perform a non-linear transform of the color components corresponding with the second color space to provide transformed color components. Second conversion module 704 may convert the transformed color components to another color space. For example, second conversion module 704 may convert the transformed color components to the first color space or to a third color space that is different from the first and second color spaces.

Figure 9:
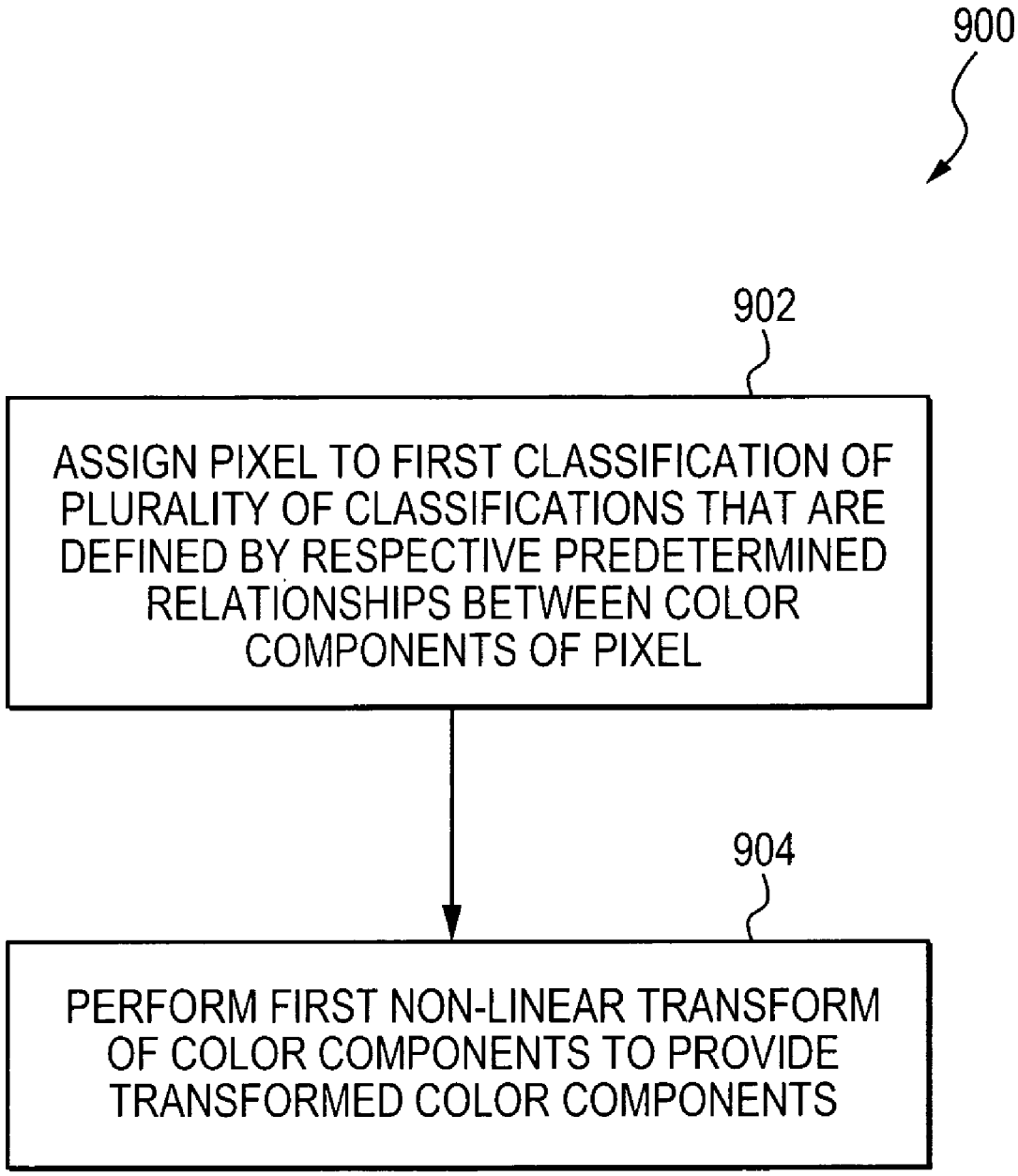
FIG. 9 is a flowchart of a method of achieving preferred color reproduction in accordance with an embodiment disclosed herein.
Figure 10:
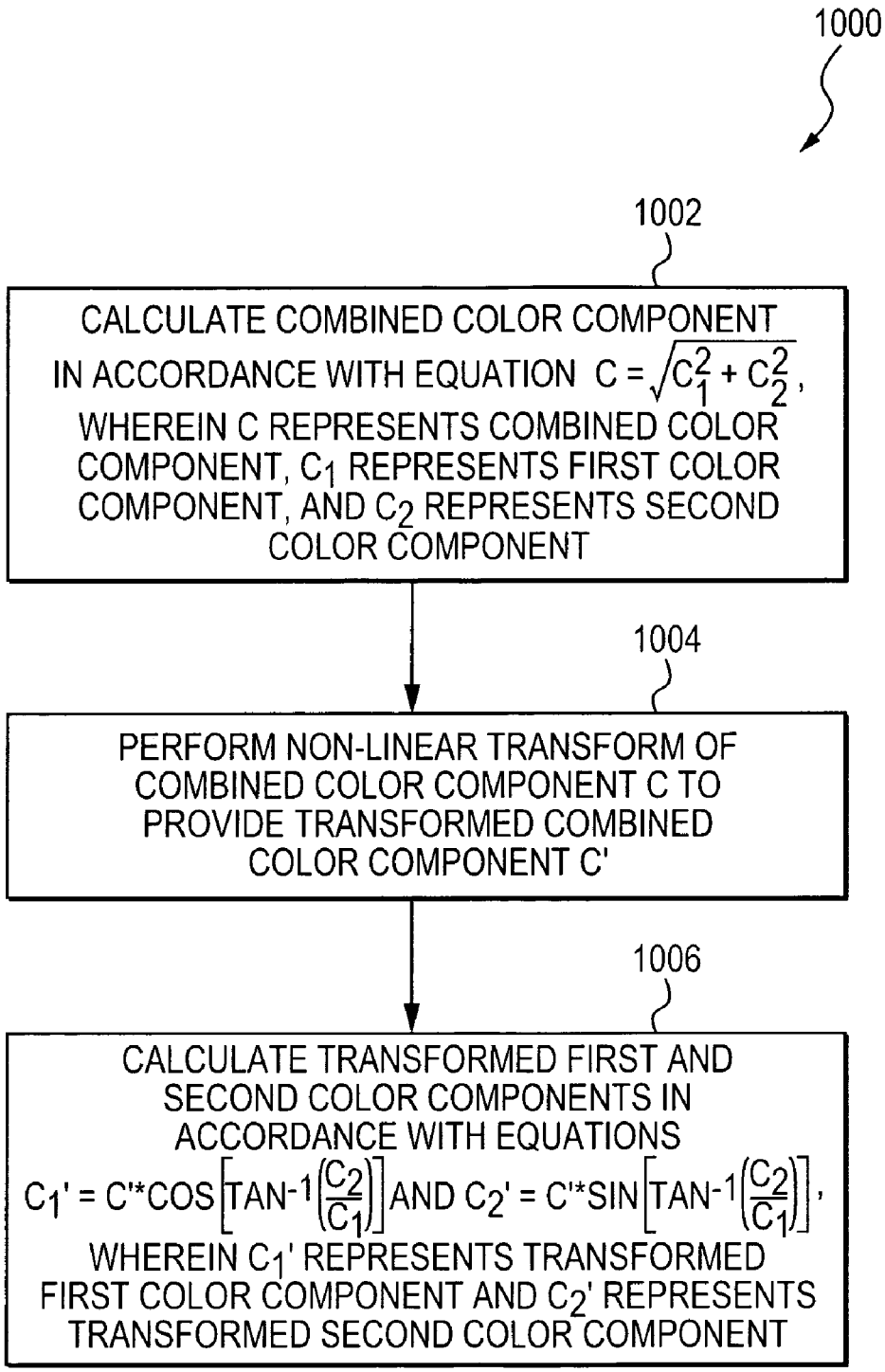
FIG. 10 is a flowchart of a method of performing a non-linear transform in accordance with an embodiment disclosed herein.

FIG. 9 is a flowchart of a method 900 of achieving preferred color reproduction in accordance with an embodiment disclosed herein. FIG. 10 is a flowchart of a method 1000 of performing a non-linear transform in accordance with an embodiment disclosed herein. The embodiments described herein, however, are not limited to the descriptions provided by the flowcharts. Rather, it will be apparent to persons skilled in the relevant art(s) from the teachings provided herein that other functional flows are within the scope and spirit of the embodiments.

Methods 900, 1000 will be described with continued reference to image processor 120 and components thereof described above in reference to FIGS. 1, 2, 7, and 8, though the methods are not limited to those embodiments.

Referring now to FIG. 9, a pixel is assigned to a first classification of a plurality of classifications that are defined by respective predetermined relationships between color components of the pixel at block 902. For example, assigning module 202 may assign the pixel to the first classification. At block 904, a first non-linear transform of the color components is performed to provide transformed color components. For instance, transform module 204 may perform the first non-linear transform.

The first non-linear transform may be performed using any of a variety of techniques. For example, the first non-linear transform of the color components may be performed independently. Alternatively, the color components may be combined to provide a combined color component, and a non-linear transform of the combined color component may be performed. The transformed combined color component may be processed to obtain the individual transformed color components. FIG. 10 provides an example implementation of the latter technique for performing the non-linear transform of the color components.

In FIG. 10, a combined color component is calculated in accordance with equation $C=\sqrt{C_1^2+C_2^2}$ at block 1002. In the equation, C represents the combined color component, $C_1$ represents the first color component, and $C_2$ represents the second color component. At block 1004, a non-linear transform is performed of the combined color component C to provide a transformed combined color component C'. At block 1006, the transformed first and second color components are calculated in accordance with equations $$C_1' = C' * \cos\left[\tan^{-1}\left(\frac{C_2}{C_1}\right)\right] \text{ and}$$

$$C_2' = C' * \sin\left[\tan^{-1}\left(\frac{C_2}{C_1}\right)\right].$$

In these equations, $C_1'$ represents the transformed first color component and $C_2'$ represents the transformed second color component.

The embodiments described herein may provide better control of color enhancement, as compared to conventional image reproduction techniques. Moreover, comparatively fewer computations may be necessary to implement these embodiments. The embodiments may reproduce more pleasing color of natural objects as compared to conventional image reproduction techniques, such as an ideal colorimetric reproduction technique. The embodiments may be capable of compensating for a color shift of a memory color from the original color stimulus. For instance, the saturation of the original color stimulus may be increased to enable the reproduced color to more closely correspond with the memory color (i.e., a preferred color). Other characteristics, including but not limited to hue, lightness, and color purity, may also be compensated to achieve preferred color reproduction of skin, foliage, sky, etc. The embodiments described herein may take into consideration any of a variety of other factors, such as image content, captured illuminants, background colors, relative lightness, observers' culture, etc.

Figure 11:
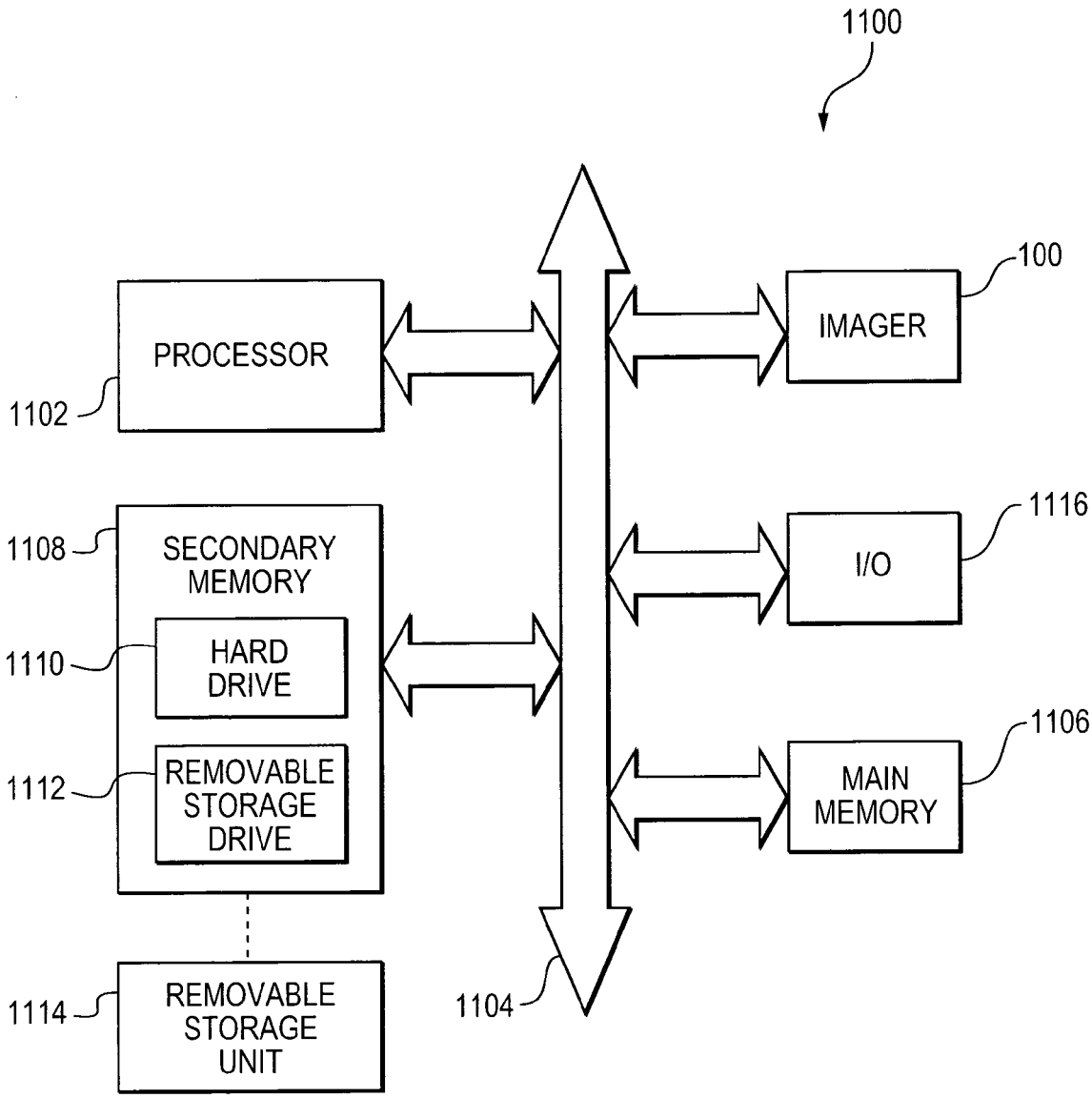
FIG. 11 is an example processor system that includes an imager in accordance with an embodiment disclosed herein.

FIG. 11 is a block diagram of an example processor system 1100 that includes an imager, such as imager 100 of FIG. 1, in accordance with an embodiment disclosed herein. Processor system 1100 will be described with reference to imager 100 for convenience. Processor system 1100 is capable of performing the preferred color reproduction techniques described herein. For example, the techniques may be performed exclusively by imager 100 or may be shared among imager 100 and other components of processor system 1100. Without being limiting, processor system 1100 may include a computer system, camera system, scanner, machine vision, vehicle navigation, video phone, surveillance system, auto focus system, star tracker system, motion detection system, image stabilization system, data compression system, etc.

Referring to FIG. 11, imager 100 provides an image from a pixel array. Processor system 1100 includes one or more processors, such as processor 1102, which are capable of processing the image. Processor 1102 may be any type of processor, including but not limited to a special purpose or a general purpose digital signal processor. Processor system 1100 also includes a main memory 1106, preferably random access memory (RAM), and may also include a secondary memory 1108. Secondary memory 1108 may include, for example, a hard disk drive 1110 and/or a removable storage drive 1112, representing a floppy disk drive, a magnetic tape drive, an optical disk drive, etc. Removable storage drive 1112 reads from and/or writes to a removable storage unit 1114 in a well known manner. Removable storage unit 1214 represents a floppy disk, magnetic tape, optical disk, etc. As will be appreciated, removable storage unit 1114 includes a computer usable storage medium having stored therein computer software and/or data.

Communication infrastructure 1104 (e.g., a bus or a network) facilitates communication among the components of processor system 1100. For example, imager 100, input/output (I/O) device 1116, main memory 1106, and/or secondary memory 1108 may communicate with processor 1102 or with each other via communication infrastructure 1104.

Processor system 1100 may further include a display interface, which forwards graphics, text, and/or other data from communication infrastructure 1104 (or from a frame buffer not shown) for display on a display unit.

According to the embodiments described herein, imager 100 may be combined with a processor, such as a CPU, digital signal processor, or microprocessor, with or without memory storage on a single integrated circuit or on a different chip than the processor.

It will be recognized by persons skilled in the relevant art(s) that the preferred color reproduction techniques described herein may be implemented as control logic in hardware, firmware, or software or any combination thereof.

Figure 12:
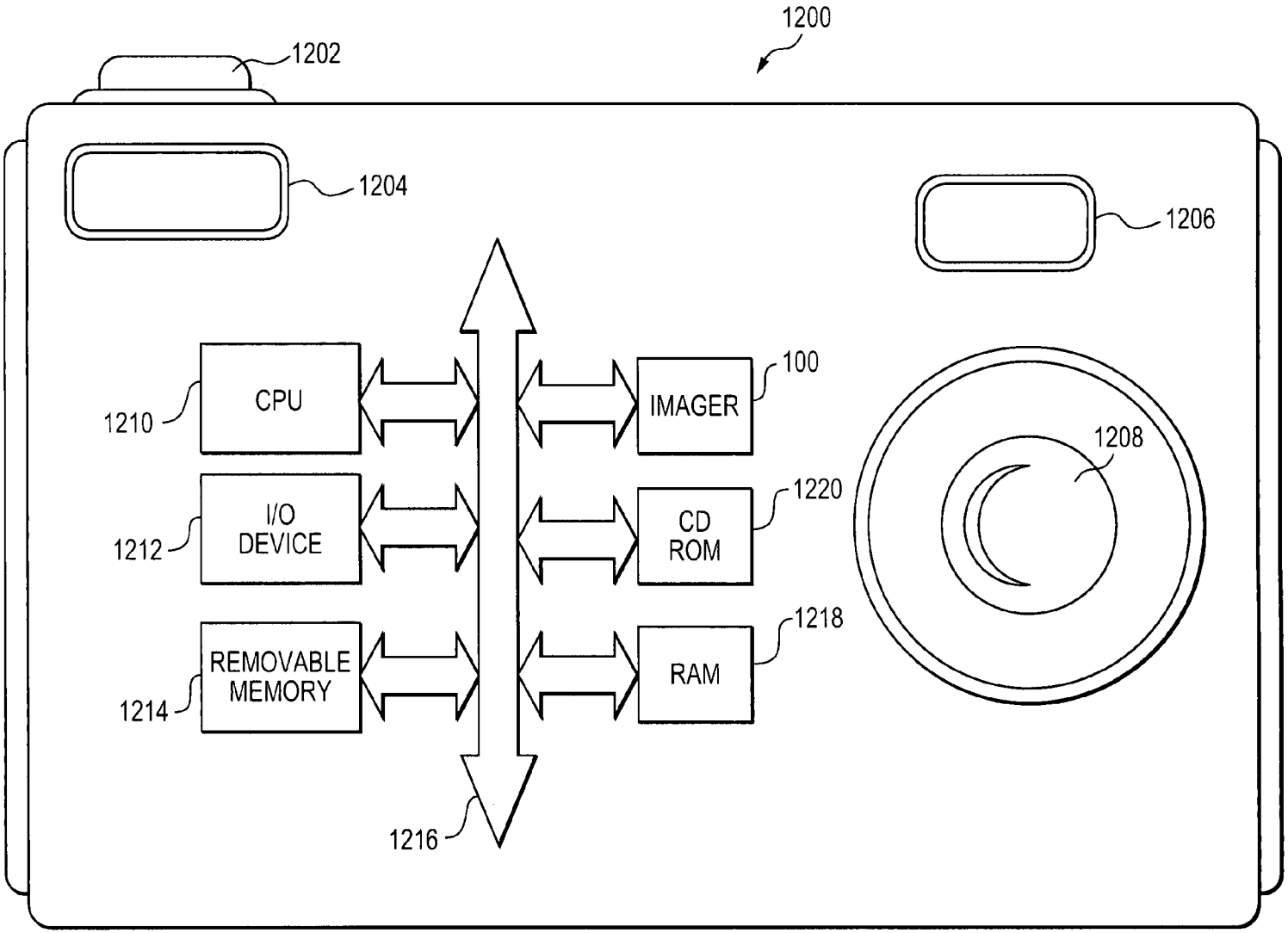
FIG. 12 is a block diagram of an image processing system, incorporating an imager in accordance with the method and apparatus embodiments described herein.

FIG. 12 is a block diagram of an image processing system, e.g., a camera system, 1200 incorporating an imager 100 in accordance with the method and apparatus embodiments described herein. In FIG. 12, imager 100 provides an image output signal as described above. A camera system 1200 generally includes a shutter release button 1202, a view finder 1204, a flash 1206 and a lens system 1208. A camera system 1200 generally also includes a camera control central processing unit (CPU) 1210, for example, a microprocessor, that communicates with one or more input/output (VO) devices 1212 over a bus 1216. CPU 1210 also exchanges data with random access memory (RAM) 1218 over bus 1216, typically through a memory controller. A camera system may also include peripheral devices such as a removable flash memory 1220, which also communicates with CPU 1210 over bus 1216.

Example embodiments of methods, systems, and components thereof have been described herein. As noted elsewhere, these example embodiments have been described for illustrative purposes only, and are not limiting. Other embodiments and modifications, though presently unforeseeable, of the embodiments described herein are possible and are covered by the invention. Such other embodiments and modifications will be apparent to persons skilled in the relevant art(s) based on the teachings contained herein. Thus, the breadth and scope of the present invention should not be limited by any of the above described exemplary embodiments, but should be defined only in accordance with the following claims and their equivalents.

What is claimed as new and desired to be protected by Letters Patent of the United States is:

1. An image processor comprising:

an assigning module on the image processor configured to assign an image pixel to a first classification of a plurality of classifications that are defined by respective predetermined relationships between color components of the image pixel; and a transform module on the image processor configured to perform a first non-linear transform of the color components of the first classification to provide transformed color components for image pixels in the first classification, wherein the color components include a blue chroma component and a red chroma component, wherein the first classification is defined by relationships $C_b<C_r$ and $C_b>10*C_r$, wherein $C_b$ represents the blue chroma component, and wherein $C_r$ represents the red chroma component.

2. The image processor of claim 1, wherein each classification of the plurality of classifications corresponds to a different non-linear transform, and the transform module is configured to perform respective different non-linear transforms of color components in the different classifications.

3. The image processor of claim 1, wherein a second classification in the plurality of classifications is defined by relationships $$C_b < -\frac{5}{2} * C_r \text{ and } C_b > -\frac{3}{5} * C_r.$$

4. The image processor of claim 1, wherein a second classification in the plurality of classifications is defined by relationships $$C_b < -\frac{1}{10} * C_r \text{ and } C_b > -\frac{5}{4} * C_r \text{ and } R < \frac{7}{4} * G;$$

wherein $C_b$ represents the blue chroma component, wherein $C_r$ represents the red chroma component, and wherein R and G represent respective red and green color components in an RGB color space based on the blue and red chroma components.

5. The image processor of claim 1, wherein the first non-linear transform has a sigmoidal response.

6. The image processor of claim 1, wherein the first non-linear transform is defined by the equations $$y=a^{1-\gamma}*x^{\gamma} \text{ for } 0<x<a \text{ and}$$

$$y=1-(1-a)^{1-\gamma}(1-x)^{\gamma} \text{ for } a<x\leqq 1;$$

wherein y represents a respective transformed color component when x represents the respective color component, wherein a represents a transition point of the first non-linear transform, and wherein γ represents a linearity factor of the first non-linear transform.

7. The image processor of claim 6, wherein γ=1.

8. The image processor of claim 6, wherein γ=5/4.

9. The image processor of claim 6, wherein y=3/2.

10. The image processor of claim 1, wherein the first non-linear transform is defined in accordance with equations $$C = \sqrt{C_1^2 + C_2^2}, \quad C_1' = C' * \cos\left[\tan^{-1}\left(\frac{C_2}{C_1}\right)\right], \text{ and}$$

$$C_2' = C' * \sin\left[\tan^{-1}\left(\frac{C_2}{C_1}\right)\right],$$

wherein C represents a combined color component, $C_1$ represents a first color component, $C_2$ represents a second color component, C' represents a transformed combined color component, $C_1'$ represents the transformed first color component, and $C_2'$ represents the transformed second color component;

wherein the transform module is configured to perform a non-linear transform of the combined color component C to provide the transformed combined color component C'.

11. The image processor of claim 1, wherein the transform module is configured to perform the first non-linear transform of the first color component independently from the first non-linear transform of the second color component.

12. An imager comprising:

a pixel array including a first pixel that provides electrons based on photons incident on the first pixel; and an image processor coupled to the pixel array, said processor comprising:

an assigning module configured to assign an image pixel corresponding to the first pixel to a first classification of a plurality of classifications that are defined by respective predetermined relationships between a first color component and a second color component of the image pixel, wherein each classification of the plurality of classifications corresponds to a different non-linear transform; and a transform module configured to perform a first non-linear transform of the first color component and the second color component to provide a transformed first color component and a transformed second color component, wherein the first non-linear transform corresponds to the first classification, wherein the first non-linear transform is defined by the equations $$y=a^{1-\gamma}*x^{\gamma} \text{ for } 0<x<a \text{ and}$$

$$y=1-(1-a)^{1-\gamma}(1-x)^{\gamma} \text{ for } a<x\leqq 1$$

wherein y represents a respective transformed color component when x represents the respective color component, wherein a represents a transition point of the first non-linear transform, and wherein γ represents a linearity factor of the first non-linear transform.

13. The imager of claim 12, wherein the first and second color components are color components selected from the group consisting of a YCbCr color space, a Y'CbCr color space, a CIELAB color space, a YUV color space, a YIQ color space, a YDbDr color space, and a YPbPr color space.

14. The imager of claim 12, wherein the first classification is defined by relationships between the first color component and the second color component that are indicative of grass.

15. The imager of claim 12, wherein the first classification is defined by relationships between the first color component and the second color component that are indicative of the sky.

16. The imager of claim 12, wherein the first classification is defined by relationships between the first color component and the second color component that are indicative of skin color.

17. A method comprising:

with an image processor, assigning an image pixel to a first classification of a plurality of classifications that are defined by respective predetermined relationships between a first color component and a second color component of the image pixel, each classification of the plurality of classifications corresponding with a different non-linear transform; and with the image processor, performing a first non-linear transform of the first color component and the second color component to provide a transformed first color component and a transformed second color component, the first non-linear transform corresponding with the first classification, wherein performing the first non-linear transform of the first color component and the second color component includes:

with the image processor, calculating a combined color component in accordance with equation $C\sqrt{C_1^2+C_2^2}$, wherein C represents the combined color component, $C_1$ represents the first color component, and $C_2$ represents the second color component;

with the image processor, performing a non-linear transform of the combined color component C to provide a transformed combined color component C'; and with the image processor, calculating the transformed first and second color components in accordance with equations $$C_1' = C' * \cos\left[\tan^{-1}\left(\frac{C_2}{C_1}\right)\right] \text{ and } C_2' = C' * \sin\left[\tan^{-1}\left(\frac{C_2}{C_1}\right)\right],$$

wherein $C_1'$ represents the transformed first color component and $C_2'$ represents the transformed second color component.

18. The method of claim 17, wherein assigning the image pixel includes determining that the respective values of the first color component and the second color component satisfy predetermined relationships between the first color component and the second color component that are indicative of grass.

19. The method of claim 17, wherein assigning the image pixel includes determining that the respective values of the first color component and the second color component satisfy predetermined relationships between the first color component and the second color component that are indicative of the sky.

20. The method of claim 17, wherein assigning the image pixel includes determining that the respective values of the first color component and the second color component satisfy predetermined relationships between the first color component and the second color component that are indicative of skin color.

* * * * *